US005884634A

United States Patent [19]

Sheffler et al.

[11] Patent Number: 5,884,634

[45] Date of Patent: Mar. 23, 1999

[54] MASCARA CONTAINER AND DISPENSER

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 990,977

[22] Filed: Dec. 15, 1997

[51] Int. Cl.[6] ..... A45D 40/26

[52] U.S. Cl. ..... 132/218; 401/122

[58] Field of Search ..... 132/218, 313, 132/317, 216; 401/122, 129

[56] References Cited

U.S. PATENT DOCUMENTS

| | | | |
|---|---|---|---|
| 4,470,425 | 9/1984 | Gueret | 132/218 |
| 4,810,122 | 3/1989 | Cole | 132/218 |
| 5,324,128 | 6/1994 | Gueret | 401/122 |

FOREIGN PATENT DOCUMENTS

| | | | |
|---|---|---|---|
| 3830641 | 5/1989 | Germany | 401/122 |

*Primary Examiner*—Todd E. Manahan

*Attorney, Agent, or Firm*—H. Gibner Lehmann; K. Gibner Lehmann

[57] ABSTRACT

A container and dispensing device for mascara and the like, has a small bottle with an externally threaded neck of reduced diameter, into which a molded plastic one-piece separator member is pressed. The device has an applicator screw cap which screws onto the bottle neck, and which has an applicator rod depending from an intermediate transverse sealing wall. The applicator rod projects from the bottom of the screw cap, being surrounded by the walls of the separator member, and carries a brush for disposition in the bottle. Above the bottom end of the separator member is a doctor blade, which normally surrounds the juncture of the brush and applicator rod. The doctor blade has an annular sealing bead which seals against the bottom surface of the applicator rod, and the latter is commensurate in diameter with that of the brush. The separator member also seals against the sealing wall of the screw cap, whereby the separator member is sealed and maintains the applicator rod in a clean condition. The orifice of the doctor blade can have numerous different configurations to effect different wiping effects on the brush as the latter is withdrawn for use.

16 Claims, 1 Drawing Sheet

12

12
18
19
20
38
14
24
16
42
22
28
30
32
34
26
10

42
42
50
36
52
42

42
46
42
36
32
42

42
54
42
36
56
42

38
40
30
42
44
36
32
34

42
58
42
36
60
42

42
62
42
36
64
42

MASCARA CONTAINER AND DISPENSER

CROSS REFERENCES TO RELATED APPLICATIONS

U.S. application Ser. No. 08/714,200 filed Sep. 16, 1996, entitled SAMPLER DEVICE FOR MASCARA AND OTHER COSMETIC SUBSTANCES, having common ownership with the present application.

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

FIELD OF THE INVENTION

This invention relates to devices for containing and dispensing mascara and like cosmetics.

DESCRIPTION OF THE RELATED ART INCLUDING INFORMATION DISCLOSED UNDER 37 CFR §§1.97–1.99

The following patents are hereby cited as being of interest in the field to which the present invention pertains:

| U. S. Patents Nos.: | | |
|---|---|---|
| 3,214,782 | 4,194,848 | 4,470,425 |
| 4,810,122 | 5,190,389 | 5,324,128 |
| 5,349,972 | 5,490,737 | 5,597,254 |

U.S. Pat. No. 5,324,128 dated Jun. 28, 1994 shows a cosmetic applicator comprising a small bottle that carries mascara or similar cosmetic substance. By a series of seals and small passages it is claimed that leakage of the bottle contents is prevented. However, multiple components of somewhat complicated shapes are involved, with the result that labor in assemblage becomes significant, as well as component costs, and maximum economy of manufacture is difficult to obtain.

The disclosure of U.S. Pat. No. 4,470,425 involves a mascara container and applicator wherein multiple wiper devices are provided, one for the applicator brush and the other for the brush carrier rod, FIG. 3 and col. 4, line 44. Both wiper devices are positioned close to each other, and the rod wiper engages and seals against the side wall of the carrier rod, approximately midway between the rod ends, FIG. 1. Thus, lower portions of the rod are exposed to the mascara product which is in the container, and the cleanliness of this rod portion depends on the effectiveness of the wiper device. If the wiper deteriorates or loses elasticity, the carrier rod can become smudged, leading to messy operation.

In U.S. application Ser. No. 08/714,200 above identified, a mascara sampler device is disclosed that does not effect a doctoring of the product being removed from the container, but does provide a considerable simplification of structure and economy of manufacture while at the same time overcoming other disadvantages of the 1994 U.S. Pat. No. 4,470,425.

The remaining patents listed above relate generally to cosmetic applicators having wiping mechanisms for the applicator tip. These take a number of different forms.

In U.S. Pat. No. 5,349,972, dual wipers are provided. An inner wiper purportedly functions to remove product from the bristles, whereas an outer, larger wiper acts upon the applicator stem as it is withdrawn.

U.S. Pat. No. 5,597,254 similarly utilizes dual wipers, in one disclosed embodiment. The operation of the construction illustrated in FIGS. 9 and 10 of the patent is described briefly in columns 5 and 6. Essentially, the two wipers are intended to remove any excess cosmetic material from both the rod and brush. The outer wiper is preferably constituted of rubber having increased flexibility as compared with the material of the inner wiper 20.

U.S. Pat. No. 5,190,389 discloses a container having a single wiper that is secured in the neck of a bottle by means of a separate wiper ring, with a press fit. The wiper acts upon both the brush and the applicator rod, as explained in column 4 of the patent. The patentee claims wide applicability of the device, as by permitting different-sized wiper mechanisms to be adapted to multiple bottle sizes and configurations.

U.S. Pat. No. 4,810,122 also discloses an applicator device utilizing a wiper mechanism disposed at a container neck. The applicator stick is provided with a series of bristles that project generally laterally of the stick, and a number of different complementary openings can be imparted to particular wiper designs, respectively. FIGS. 7 and 8 of the patent illustrate openings having respectively, four and three slits that extend radially from a central opening. Turning of the applicator stick as it is being withdrawn from the container results in a greater or lesser wiping action, depending on the orientation of the bristles with respect to the slit or slits.

U.S. Pat. No. 3,214,782 also discloses wiper constructions having openings of different cross sectional configuration, for metering the quantity of mascara that adheres to the brush as the applicator part is being withdrawn. U.S. Pat. No. 4,194,848 similarly accomplishes a metering effect by providing a wiper mechanism having means for adjustably varying the size of the wiper opening, generally by turning of a tubular insert carried in the container neck.

U.S. Pat. No. 5,490,737 relates to a cosmetic dispenser having a wiping device mounted in the neck of the dispensing container, and wherein the device is provided with flocking fibers that surround its inner end. As the applicator stick is withdrawn, the fibers engage the applicator brush to the point that excess cosmetic material is removed from the same.

A significant disadvantage of the various patented applicator constructions lies in the fact that the applicator stick or rod was exposed, at least in part, to the reservoir containing the cosmetic substance. As a consequence, the rod became coated with the material, giving rise to inadvertent soiling of the hands, or of clothing, etc. Little attention to this problem has been given, as far as can be determined from known prior art devices.

SUMMARY OF THE INVENTION

Accordingly, the above drawbacks of prior dispenser and sampler devices are largely overcome by the present invention, and one object of the invention is to provide an improved mascara container and dispenser which is especially simple in its structure while at the same time being leakproof and spillproof.

Another object of the invention is to provide an improved mascara container and dispenser of the kind indicated, wherein the applicator rod is largely isolated from the cosmetic material, thereby minimizing undesirable accumulation of the material on the rod per se. With such an arrangement, most of the cosmetic material is confined to the applicator brush, as intended. There is thus minimized inadvertent soiling of the hands or clothing, from contact with the rod.

Yet another object of the invention is to provide an improved mascara container and dispenser as above set forth, wherein the cosmetic material in the container is isolated from the outside when the applicator rod is in place, minimizing leakage as noted above, and also minimizing contact with air, which might tend to dry out the material.

Still another object of the invention is to provide an improved mascara dispenser device as above characterized, which is especially economical to produce.

A still further object of the invention is to provide an improved mascara dispenser in accordance with the foregoing, which is small and compact as well as being reliable in its operation at all times.

In accomplishing the above objects the invention provides a mascara dispenser device comprising a bottle for holding the cosmetic substance, the bottle having an externally threaded neck of reduced diameter and a molded plastic screw cap applicator comprising a body which is screwed on the bottle neck. The screw cap body has a transverse sealing wall disposed intermediate its ends, and an applicator rod extending downward from the transverse sealing wall, with the upper half portion of the rod forming an annular cavity in the underside of the screw cap body, which cavity is occupied by the reduced neck of the bottle. The lower half portion of the applicator rod projects from the bottom of the screw cap body and carries at its lower extremity, an applicator brush that is connected at a junction to the lower extremity of the rod. A cup-shaped separator member or shroud extends through and is carried by the reduced neck portion of the bottle. The separator member encloses the lower projecting half portion of the applicator rod and has an annular doctor blade which surrounds the junction between the applicator rod and the brush, and controls the amount of cosmetic substance that is withdrawn by the brush.

The separator member also has a depending annular skirt that projects downward from the doctor blade. The lower extremity of the applicator rod has an annular sealing surface and the doctor blade has a sealing bead that is cooperable with the annular sealing surface of the rod to seal the interior of the separator member from the contents of the bottle when the applicator is screwed onto the bottle. In addition, the separator member has an upper lip portion that is engageable with the transverse sealing wall of the screw cap body at the same time that the applicator rod seals against the sealing bead of the doctor blade, thereby to enclose and isolate the applicator rod and prevent its contamination.

Other features and advantages will hereinafter appear.

BRIEF DESCRIPTION OF THE DRAWINGS

In the accompanying drawings, showing preferred embodiments of the invention.

DESCRIPTION OF THE PREFERRED EMBODIMENTS

Figures 1, 2, 3, 4, 5, 6, 7, 8:
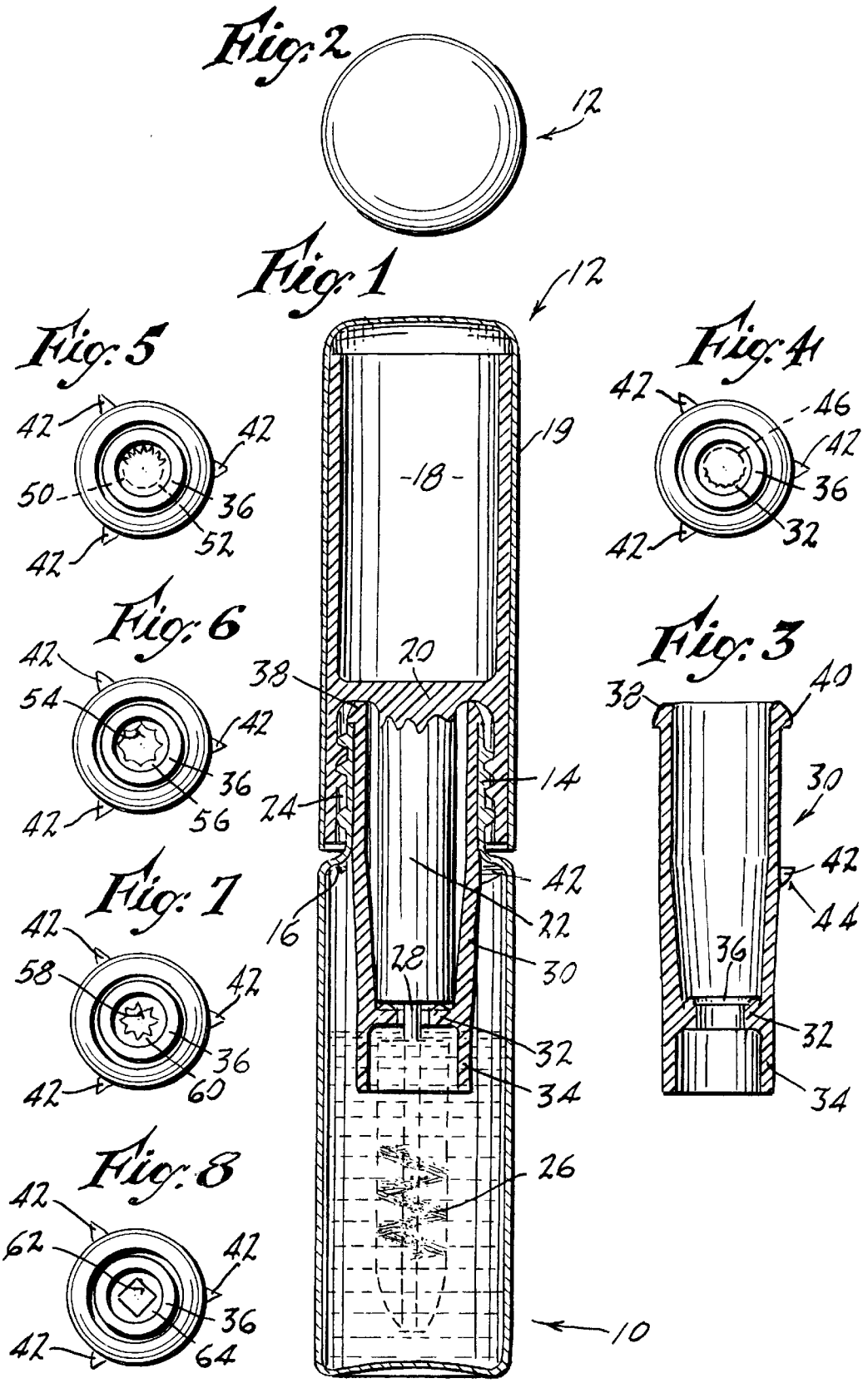
FIG. 1 is an axial sectional view of the dispensing device in its closed condition.
FIG. 2 is a top plan view of the device of FIG. 1.
FIG. 3 is an axial sectional view of the molded plastic one-piece separator member of the dispensing device.
FIG. 4 is a top plan view of the molded separator member.
FIG. 5 is a top plan view of a molded separator device according to another embodiment of the invention.
FIG. 6 is a top plan view of a molded separator device according to still another embodiment of the invention.
FIG. 7 is a top plan view of a molded separator device according to yet another embodiment of the invention.
FIG. 8 is a top plan view of a molded separator device according to a still further embodiment of the invention.

Referring first to FIG. 1, the improved mascara dispensing device of the invention comprises essentially two main parts, a container or bottle part indicated generally by the numeral 10, and a removable screw cap applicator part which is indicated generally by the numeral 12. The bottle part 10 is adapted to contain mascara or similar cosmetic substance, indicated by the broken line representation in FIG. 1, and could be conveniently fabricated as a metal component, with external threads on a reduced-diameter neck portion 14. By virtue of the smaller diameter of the neck portion 14 there is formed in the bottle 10 an annular internal shoulder 16, for purposes to be later described.

The applicator screw cap 12 is adapted to be screwed onto the threaded neck portion 14 of the bottle 10, and for this purpose the applicator cap 12 has a plastic insert member 18, hereinafter also referred to as an applicator body, such body having internal screw threads suitable for cooperation with the threads of the bottle neck 14. The applicator screw cap 12 further comprises an outer metal jacket 19 which encloses the body 18.

The applicator body 18 has a transverse sealing wall 20 which is disposed below the midpoint of the top and bottom of the screw cap 12, as clearly seen in FIG. 1, and above the internal screw threads thereof.

The applicator body 18 also has a depending applicator rod 22 which is preferably a solid cylinder, having a cylindrical side surface and a bottom end wall. The rod 22 extends downward from the transverse sealing wall 20, and the upper half portion of the rod 22 forms an annular cavity 24 in the underside of the screw cap body 18, which cavity 24 is occupied by the threaded, reduce-diameter neck 14 of the bottle 10.

The lower half portion of the applicator rod 22 projects from the bottom of the screw cap body 18 and carries at its lower extremity an applicator brush 26 that forms a junction 28 with the rod 22, as seen in FIG. 1.

The invention provides a unique, cup-shaped one-piece molded plastic separator member 30, FIGS. 1 and 3, which extends through and is carried by the reduced neck 14 of the bottle 10, such separator member enclosing and surrounding the lower projecting half portion of the applicator rod 22. The separator member 30 performs important sealing and other functions, as will be brought out below.

The separator member 30 has a transverse bottom wall containing an opening forming an annular doctor blade 32 which surrounds the junction 28 of the screw cap applicator 12, such junction being the separation point between the brush 26 and the rod 22. The doctor blade 32 controls the amount of cosmetic substance that is to be withdrawn by the brush 26. The separator member 30 also has a depending annular skirt 34 that projects downward from the doctor blade 32, the function of which is later described.

One of the important sealing functions of the separator member or shroud 30 is to keep the applicator rod 22 clean and free of cosmetic substance, and in accomplishing this the bottom wall containing the doctor blade 32 is provided with an annular sealing bead 36 which squarely engages and seals against the bottom end or extremity surface of the rod 22 when the applicator cap 12 is threaded onto the bottle 10, all as shown in FIG. 1.

Also, the separator member 30 has an upper lip or rim portion 38 that is engageable with and seals with the transverse sealing wall 20 of the screw cap body 18 of the applicator. The rim 38 has a flange portion 40 which engages the rim of the reduced neck 14 of the bottle 10, thereby to effectuate a seal therewith.

It will now be understood that with the above construction the top rim 38 of the separator member 30 constitutes a seal that is located between the transverse wall 20 of the screw cap body 18 and the top rim of the bottle neck 14, and that the sealing bead 36 of the separator member 30 seals against the bottom extremity of the applicator rod 22. The applicator rod is thus effectively enclosed by the separator member 30 and is kept away from the cosmetic substance in the bottle 10.

Retention of the separator member 30 in the bottle neck 14 is effected by a plurality of resilient wing formations 42 projecting from the exterior of the member 30 at points midway of the top and bottom thereof, said wings having camming surfaces 44 by which the wings can be forced into a flat shape and through the neck 14 of the bottle when the separator member 30 is forcibly pushed through the neck 14, thereby to enable the wings to engage with the internal shoulder 16 of the bottle.

According to the invention, the doctor blade 32 of the separator member 30 can have various different configurations at its inner periphery, to effect different kinds of control of the cosmetic substance which will be carried by the brush 26. In FIG. 4 the inner periphery 46 of the doctor blade 32 has multiple fine scallops for engagement by the brush 26.

In FIG. 5, the inner periphery 50 of the doctor blade 52 has a serrated configuration. In FIG. 6, the inner periphery 54 of the doctor blade 56 has a scalloped configuration. In FIG. 7, the inner periphery 58 of the doctor blade 60 has a star-shaped configuration. And in FIG. 8, the inner periphery 62 of the doctor blade 64 has a square configuration. In each of FIGS. 4–8, the annular sealing beads which are on the doctor blades are indicated by the numeral 36.

The depending skirt 34 on the separator member 30 can drain excess mascara from the brush as the latter is withdrawn; it also fosters retention of the doctored mascara within it so that the bristles of the brush 26 are drawn through the product tunnel or passage, coating the tuft of the brush even when the mascara is nearly exhausted from the lower portion of the bottle 10.

It will now be seen from the foregoing that we have provided an improved and simplified dispenser for mascara and like cosmetic substances, which has few components that are arranged in a small and compact package. The applicator screw cap has a large expanse that is disposed above the transverse sealing wall 20, enabling an easy and comfortable grip to be had when applying the mascara. The various components are readily economically fabricated and assembled, making for a low-cost package.

Each and every one of the appended claims defines an aspect of the invention which is complete in and of itself, separate and distinct from all the others, and accordingly it is intended that each claim be treated in this manner when examined in the light of the prior art devices in any determination of novelty or validity.

Variations and modifications are possible without departing from the spirit of the invention, and portions of the improvement can be used without others.

What is claimed is:

1. A container and dispensing device for mascara and like cosmetic substances, comprising in combination:

a) a bottle for holding said cosmetic substances, said bottle having an externally threaded neck of reduced diameter, b) a molded plastic screw cap applicator comprising a body which is screwed on said bottle neck, said screw cap body having internal threads engaged with the threaded bottle neck and having a transverse sealing wall disposed above said internal threads, c) said applicator body having an applicator rod extending downward from its transverse sealing wall and said applicator rod having an upper portion which forms an annular cavity in the underside of the screw cap body, which cavity is occupied by the reduced neck of the bottle, d) the lower half portion of said applicator rod projecting from the bottom of the screw cap body and carrying at its lower extremity an applicator brush that forms a junction at said lower extremity, e) a cup-shaped separator member extending through and carried by the reduced neck portion of the bottle, f) said separator member enclosing the lower projecting half portion of the applicator rod and having an annular doctor blade which surrounds the said junction between the applicator rod and brush and which controls the amount of cosmetic substances that are to be withdrawn by the brush, g) said separator member having a depending annular skirt that projects downward from the doctor blade thereof, h) said lower extremity of the applicator rod having an annular sealing surface and said doctor blade having a sealing bead that is cooperable with said annular sealing surface to seal the interior of the separator member from the contents of the bottle when the applicator is screwed onto the bottle, i) said separator member having an upper lip portion that is engageable with the transverse sealing wall of the screw cap body at the time that the applicator rod seals against the said sealing bead.

2. A container and dispenser as set forth in claim 1, wherein the separator member is constituted as a one-piece molded plastic component.

3. A container and dispenser as set forth in claim 1, and further including:

a) retainer means on the bottle and separator member, holding the separator member captive and fixed in the bottle.

4. A container and dispenser as set forth in claim 3, wherein said retainer means comprises an internal shoulder of the bottle, formed by the reduction in diameter of the externally threaded neck of the bottle.

5. A container and dispenser as set forth in claim 4, wherein the retainer means further comprises a plurality of resilient wing formations on the exterior of the separator member, engageable with the internal shoulder of the bottle.

6. A container and dispenser as set forth in claim 5, wherein the resilient wing formations have camming surfaces which, when experiencing forces, can flatten the wings so as to enable the separator member to be forced into the bottle past the neck of reduced diameter thereof,

7. A container and dispenser as set forth in claim 1, wherein the annular doctor blade of the separator member has an inner periphery of star-shaped configuration.

8. A container and dispenser as set forth in claim 1, wherein the annular doctor blade of the separator member has an inner periphery of scalloped configuration.

9. A container and dispenser as set forth in claim 1, wherein the annular doctor blade of the separator member has an inner periphery of serrated configuration.

10. A container and dispenser as set forth in claim 1, wherein the annular doctor blade of the separator member has an inner periphery comprised of multiple fine scallops.

11. A container and dispenser as set forth in claim 1, wherein the annular doctor blade of the separator member has an inner periphery of square configuration.

12. A container and dispenser as set forth in claim 1, wherein the transverse sealing wall of the screw cap applicator is located in the transverse wall of said shroud.

13. A container and dispensing device for mascara and like cosmetic substance, comprising in combination:

a) a bottle for holding said cosmetic substance, said bottle having a neck and a shroud axially-disposed inside the neck, said shroud having a bottom end portion located in the bottle and having a flat transverse wall disposed in said bottom end portion at substantially 90° to the axis of the shroud, said flat transverse wall having an opening communicating with the interior of the bottle, and said shroud comprising at its bottom end portion a depending open-bottom skirt which defines a drainage space that also communicates with the interior of the bottle, b) a plastic cap for the bottle, said cap having an applicator rod that extends into the shroud when the cap is assembled to the bottle, c) said applicator rod having a brush extending from its remote end and through the opening in the transverse wall of the shroud, and into the interior of the bottle when the cap is assembled to the same, d) said applicator rod being elongate, having a peripheral outer surface and having a flat, planar end wall from which said brush extends, and e) squarely-abutting sealing means at the said opening in the transverse wall of said shroud and including said planar end wall of the applicator rod, sealingly closing off the interior of the bottle from the peripheral outer surface of the applicator rod, so as to positively prevent cosmetic substance from coming into contact with the peripheral surface of the applicator rod when the cap is assembled to the bottle, f) said skirt of the shroud being adapted to receive an upper part of said brush to foster retention of doctored mascara in the skirt for coating the brush as the latter is being withdrawn from the bottle.

14. A container and dispensing device as set forth in claim 13, wherein:

a) said applicator rod comprises a solid cylinder and the end wall thereof is substantially perpendicular to the axis of the cylinder.

15. A container and dispensing device as set forth in claim 14, wherein:

a) said transverse wall of the shroud is substantially parallel to the end wall of said solid cylinder, and spaced a finite distance therefrom.

16. A container and dispensing device as set forth in claim 15, wherein:

a) said sealing means comprises an upstanding bead on the transverse wall of the shroud, that is engaged by the end wall of the cylinder.

* * * * *